US008991179B2

(12) United States Patent
Berger et al.

(10) Patent No.: US 8,991,179 B2
(45) Date of Patent: Mar. 31, 2015

(54) DRIVE UNIT AND METHOD FOR ITS OPERATION

(75) Inventors: Jürgen Berger, Gerstetten (DE); Stephan Bartosch, Rammingen (DE)

(73) Assignee: Steamdrive GmbH, Heidenheim (DE)

( * ) Notice: Subject to any disclaimer, the term of this patent is extended or adjusted under 35 U.S.C. 154(b) by 1193 days.

(21) Appl. No.: 12/844,908

(22) Filed: Jul. 28, 2010

(65) Prior Publication Data

US 2011/0023483 A1 Feb. 3, 2011

(30) Foreign Application Priority Data

Jul. 31, 2009 (DE) ..... 10 2009 035 861

(51) Int. Cl.

| | |
|---|---|
| ***F01K 23/10*** | (2006.01) |
| ***F01M 1/12*** | (2006.01) |
| ***F01K 15/02*** | (2006.01) |
| ***F01K 25/06*** | (2006.01) |
| ***F01K 27/02*** | (2006.01) |
| ***F01P 3/12*** | (2006.01) |
| ***F01P 9/02*** | (2006.01) |

(52) U.S. Cl.

CPC ..... *F01M 1/12* (2013.01); *F01K 15/02* (2013.01); *F01K 23/10* (2013.01); *F01K 25/065* (2013.01); *F01K 27/02* (2013.01); *F01P 3/12* (2013.01); *F01P 9/02* (2013.01)

USPC ..... 60/618

(58) Field of Classification Search

USPC ..... 508/110, 283, 547; 60/645–681

See application file for complete search history.

(56) References Cited

U.S. PATENT DOCUMENTS 3,973,398 A * 8/1976 Kittle ..... 60/427
4,463,566 A * 8/1984 Guidoboni et al. ..... 60/605.1

(Continued)

FOREIGN PATENT DOCUMENTS

DE 10259488A1 A1 7/2004
DE 10328289B3 B3 1/2005

(Continued)

OTHER PUBLICATIONS

Bausch, Working Fluid for a Steam Circuit Process and Method for Operation Thereof. Nov. 6, 2008. WO 2008/131810. (US Nat'l Stage—PG Pub. 2010/0139273).*

(Continued)

*Primary Examiner* — Thomas Denion
*Assistant Examiner* — Mickey France
(74) *Attorney, Agent, or Firm* — Faegre Baker Daniels LLP

(57) ABSTRACT

The invention relates to a drive unit, in particular for a vehicle drive, comprising a drive machine generating driving power, a cooling system for the fluid cooling of the drive machine and/or a component of the drive unit which is supplied at least indirectly with driving power by the drive machine, wherein in the cooling system a coolant circulates; a lubricating circuit for the lubrication of at least one movable component of the drive unit with a lubricant.

The invention is characterized in that the drive unit further comprises an accumulation reservoir, in which a comprehensive operating fluid, which comprises a mixture of an ionic fluid and a vaporizable fluid, is stockpiled, wherein the cooling system and the lubricating circuit are at least indirectly fluidically connected to the accumulation reservoir in order to extract lubricant and coolant from the comprehensive operating fluid.

21 Claims, 2 Drawing Sheets

(56) References Cited

U.S. PATENT DOCUMENTS

| | | | | |
|---|---|---|---|---|
| 5,027,601 | A * | 7/1991 | Yoshida et al. | 60/641.5 |
| 5,667,051 | A * | 9/1997 | Goldberg et al. | 192/85.01 |
| 5,711,154 | A * | 1/1998 | Baechle et al. | 60/605.2 |
| 6,732,525 | B2 * | 5/2004 | Endoh et al. | 60/618 |
| 6,845,618 | B2 * | 1/2005 | Niikura et al. | 60/618 |
| 6,948,316 | B2 * | 9/2005 | Minemi et al. | 60/671 |
| 7,174,732 | B2 * | 2/2007 | Taniguchi et al. | 62/183 |
| 7,520,133 | B2 | 4/2009 | Hoetger et al. | |
| 2006/0277910 | A1 | 12/2006 | Hoetger | |
| 2007/0245732 | A1 * | 10/2007 | Uno et al. | 60/649 |
| 2008/0038123 | A1 * | 2/2008 | Hilgers et al. | 417/366 |
| 2009/0007857 | A1 * | 1/2009 | Esau et al. | 123/41.29 |
| 2010/0139273 | A1 * | 6/2010 | Bausch et al. | 60/651 |
| 2010/0204074 | A1 * | 8/2010 | Huesken et al. | 508/421 |
| 2010/0212304 | A1 * | 8/2010 | Hoetger | 60/320 |
| 2011/0023483 | A1 * | 2/2011 | Berger et al. | 60/618 |

FOREIGN PATENT DOCUMENTS

| | | | |
|---|---|---|---|
| DE | 102005008104 | A1 | 9/2006 |
| DE | 102005026916 | A1 | 12/2006 |
| DE | 102007043373 | A1 | 3/2009 |
| JP | 56138409 | A * | 10/1981 |

OTHER PUBLICATIONS

Hoetger, Drive Device. Aug. 2, 2007. WO 2007/014942. (US Nat'l Stage—PG Pub. 2010/0212304).*

Examination Report issued Jul. 14, 2010, in priority application No. DE102009035861.7-13.

English language translation of Examination Report dated Jul. 14, 2010 in priority application DE 102009035861.7.

* cited by examiner

DRIVE UNIT AND METHOD FOR ITS OPERATION

The invention relates to a drive unit with the characterizing features of claim 1, which in particular serves the purpose of driving a vehicle, as well as a method for its operation. Along with vehicle drives stationary drive units are also possible.

Generic drive systems with drive machines, such as for example internal combustion engines, turbines such as gas turbines, electric motors, fuel cells or expander machines in the form of screw or piston expanders typically exhibit several liquid circuits, each of which serves different purposes. Ordinarily said liquid circuits comprise a closed cooling circuit for liquid cooling of the drive machine or one of the components driven by said drive machine. In the process typically a mixture of water and frost protection agent, for example glycol, is used as a coolant. Furthermore, to achieve a high chemical and thermal stability additional additives are admixed. The cooling takes place ordinarily by means of a perfusion of parts of the housing of the drive machine in the case of a moderate excess pressure and temperatures below 115° C. for the coolant. For heavily loaded motors in addition separately arranged cooling circuits can be used, for example for piston cooling or for cooling of the bearing of turbine shafts for exhaust gas turbochargers.

In addition, ordinarily a lubricating circuit is present as an additional liquid circuit, in which mineral oil based, synthetic or semi-synthetic oils are added to the bearing components. In the process lubricants are to be adjusted, in particular with regard to the viscosity, for example to reduce the viscosity in the case of high temperature to obtain fuel economy oils.

On the other hand a requirement deviating from this purpose arises for hydraulic fluids, in particular for brake fluids. Said brake fluids must be hygroscopic in order to prevent the development of water drops within a closed brake circuit and thus be able to exclude the formation of bubbles in the case of heating. The polyglycol compounds and the added additives, for example anti-corrosives used ordinarily today meet the general requirement of a high boiling point.

Further energy-efficient drive units provide auxiliary or secondary drives for the waste heat recovery of the primary drive machine. To this purpose waste heat, for example in the exhaust of an internal combustion engine, is used for vaporization of a working fluid in an evaporator, wherein the vapor phase that develops is added to an expander for the performance of mechanical work and then enters into the evaporator again by way of a condenser as fluid phase.

From DE 103 28 289 B3 a mixture of water and at least one heterocyclic compound as well as an admixture of mixable polymers, tenside and/or other organic lubricants lubricant is known as a working fluid for a vapor circuit processing device. In particular 2-methyl pyridine, 3-methylpyridine, pyridine, pyrrole and pyridazine are proposed as heterocyclic compounds. In the process by means of the heterocyclic compound the freezing point of the operating fluid is set below 0° C. At the same time the heterocyclic compound forms an azeotrope with water, so that said compound changes to the gas phase together with the water content in the vapor generator. In this connection lubricants are likewise in the vapor phase transported to the expander for the execution of a self-lubrication.

The disadvantage of the known operating fluids for vapor circuit processes is their toxicity, so that expensive precautions must be taken in order to securely prevent the escape of the operating fluid or its gas phase. In the case of a use in vehicles, in particular motor vehicles, this cannot be completely ruled out however with regard to potential risks of accidents.

Additional, likewise adapted operating fluids arise for the operation of vehicle retarders as well as for hydraulic systems of the vehicle steering.

The invention is thus based on the object of specifying a drive unit with a simplification of the cooling system and of the lubricating circuit. In addition for an advantageous embodiment the structural design as well as the operation of auxiliary and ancillary units, such as vapor circuit processing device, a retarder as well as systems for the support of internal combustion and steering are to be simplified.

The object upon which the invention is based is solved by the features of the independent claims. Advantageous embodiments arise from the dependent claims.

The invention is based on the use of a comprehensive operating medium for the drive unit, said comprehensive operating medium being able to meet different requirements for the operation of the cooling system on the one hand and of the lubricating circuit on the other hand. In accordance with an advantageous further design the comprehensive operating medium additional serves the purpose of the operation of a vapor circuit process device and/or retarder and/or further hydraulically operated systems, for example for braking or steering of a motor vehicle. In accordance with the invention a fluid mixture is proposed as comprehensive operating fluid, said fluid mixture comprising one or more ionic fluids and a vaporizable fluid. Further additional additives can be added.

One ionic fluid is a salt with a melting point less than 100° C. at 1 bar. Preferably the ionic fluid has a melting point melting point in the pure form less than 70° C., especially preferably less than 30° C. and very especially preferably less than 0° C. at 1 bar. For an especially preferable embodiment the ionic fluid is fluid under normal conditions (1 bar, 21° C.), i.e. at room temperature.

Ionic liquids are characterized by a barely measurable vapor pressure. In additional chemically inert and temperature stabile ionic fluids can be selected so that the possibility opens up of adapting a comprehensive operating medium stored in an accumulation reservoir to the provided intended purpose by means of a change of the components of the mixture. For this purpose, by means of a separator device an at least partial separation of the ionic fluid from the vaporizable fluid can be carried out, so that different mixture ratios mixture ratios can be set between the ionic fluid and the vaporizable fluid and the mixture components ionic fluid and vaporizable fluid are essentially in the pure form in the limit.

Thus the ionic fluid or a withdrawal from the comprehensive operating medium enriched with ionic fluid can serve as a lubricant for the operation of a lubrication circuit. Due to the high temperature stability of the ionic fluid the design of the lubricating circuit is simplified. In the process in particular a separate cooling device can be dispensed with and instead of this the heated lubricant can be added to the cooling system of the drive machine, in particular to a reservoir for the coolant or in turn the accumulation reservoir for the comprehensive operating medium.

A withdrawal enriched with the vaporizable liquid or the in essence pure vaporizable fluid can serve as a coolant. As an alternative the comprehensive operating medium can be fed directly into the cooling circuit. Further for a further developed drive unit the possibility exists of providing a vapor circuit processing device whose working fluid in turn is the comprehensive operating medium or a withdrawal from the comprehensive operating medium. Especially preferably for this purpose the separator device for the separation of the ionic fluid and the vaporizable fluid is configured as an evaporator, to which the waste heat of the drive unit is added. Through evaporation at least a part of the vaporizable fluid a fluid phase enriched by the ionic fluid and a vapor phase develops, said vapor phase being directed to an expander for release and the performance of mechanical work. For an alternative embodiment a separator downstream from the evaporator can be used for separation of the vapor and fluid phase. For an advantageous embodiment the expander is connected on the output side to a reservoir for the coolant provided with sufficient buffer volume, so that a condenser on the secondary side to the expander can be dispensed with.

In addition to the function as part of a lubricant the ionic fluid in the uniform comprehensive operating medium is preferably additionally assigned the task of frost protection. In the process through the selection of the anions-cations pairing of the ionic fluid the melting point of the mixture with the vaporizable fluid is set as lying above the Freezing point.

Further the invention proceeds from a minimum percentage of 0.01 percent by weight for both the ionic fluid and the vaporizable fluid in the comprehensive operating medium. Especially preferable is a lower melting point of the mixture below −5° C., especially preferable below −10° C. and additionally preferable below −30° C. In the process with regard to the preferred temperature thresholds for a ventilated system normal pressure conditions are assumed (1013 mbar). For a closed system the respective system pressure for setting the melting point temperature is used as a reference pressure.

In the process the feature of the melting point lying below the freezing point of the vaporizable fluid should at least be applicable for the comprehensive operating fluid in a mixture ratio range that is present in the accumulation reservoir of a shutdown, cold drive unit. Preferably a proportion by weight of the vaporizable fluid of at least 10 percent by weight and no more than 90 percent by weight is assumed, more preferably for this is the interval of 20 percent by weight to 80 percent by weight. Especially preferably for the case of a cold system a weight ratio of the ionic fluid to vaporizable fluid that lies within the range of 60:40 to 40:60. Especially preferably the melting point of the mixture for the aforementioned mixture ratios lies below −5° C., especially preferably below −10° C. and further preferably below −30° C.

In the case of operation with increasing temperature the mixture ratio in the comprehensive operating fluid can shift. This can result in essentially complete separation of the ionic fluid from the comprehensive operating fluid. In the process it is conceivable within the scope of the invention to change the mixture ratio in the operation to temperature so far that the temperature condition for the melting point of the mixture, as lying below the freezing point of the vaporizable fluid, is no longer met for specified operating phases. This is still understood as part of an advantageous embodiment of the invention. After the shutdown the mixture ratio in the accumulation reservoir is again restored in order to again ensure frost protection.

Preferable ionic fluids for the implementation of the invention contain at least one organic compound as a cation, very especially preferably they contain exclusively organic compounds as cations. Suitable organic cations are in particular organic compounds with heteroatoms such as nitrogen, sulfur or phosphorous. Especially preferably it is a matter of organic compounds with at least one, preferably precisely one cationic group selected from an ammonium group, an oxonium group, a sulfonium group or a phosphonium group.

In particular ionic fluids are possible which as an anion contains a C1 through C4 alkyl sulfonate, preferably methyl sulfonate, a completely or partially fluorinated C1 through C4 alkyl sulfonate, preferably trifluormethyl sulfonate. Especially preferred ionic fluids are those containing a cation of formula IV a (pyridinium) or IV e (imidazolinium) or IV x (phosphonium) or IV y (morpholinium) and as an anion a C1 through C4 alkyl sulfonate, preferably methyl sulfonate, a completely or partially fluorinated C1 through C4 alkyl sulfonate, preferably trifluormethyl sulfonate, or in a very especially preferable embodiment consist exclusively of one such cation and ion.

In a special embodiment in the case of the ionic fluids it is a matter of salts with ammonium cations, where what is understood are compounds with tetracovalent nitrogen and localized positive charge am nitrogen or aromatic ring systems with at least one, preferably one or two, especially preferably two nitrogen atoms in the ring system and one delocalized positive charge.

Especially preferable ammonium cations are the imidazolinium cations, where all compounds with an imidazolinium ring system and if applicable random substituents on the carbon and/or nitrogen atoms of the ring system are understood.

In the case of the anion it can be a matter of an organic or inorganic anion. Especially preferably ionic fluids consist exclusively of the salt of an organic cation with one of the following named anions.

The molecular weight of the ionic fluids is preferably less than 2000 g/mol, especially preferably less than 1500 g/mol, especially preferably less than 1000 g/mol and very especially preferably less than 750 g/mol; in a special embodiment the molecular weight lies between 100 and 750 or between 100 and 500 g/mol.

Suitable ionic fluids are in particular salts of the following general formula I $$[A]_n^+[Y]^{n-} \quad \text{(I)}$$

in which n stands for 1, 2, 3 or 4, $[A]^+$ stands for an ammonium cation, an oxonium cation, a sulfonium cation or a phosphonium cation and $[Y]^{n-}$ stands for a monovalent, bivalent, trivalent or tetravalent anion;

Or mixed salts of the general formula (II)

$$[A^1]^+[A^2]^+[Y]^{2-} \quad \text{(IIa);}$$

$$[A^1]^+[A^2]^+[A^3]^+[Y]^{3-} \quad \text{(IIb);}$$

$$[A^1]^+[A^2]^+[A^3]^+[A^4]^+[Y]^{4-} \quad \text{(IIc),}$$

wherein $[A1]^+$, $[A2]^+$, $[A3]^+$ and $[A4]^+$ are selected independently from one another from the groups named for $[A]^+$ and $[Y]^{n-}$ has the significance named under B1); or mixed salts of the general formulas (III)

$$[A^1]^+[A^2]^+[A^3]^+[M^1]^+[Y]^{4-} \quad \text{(IIIa);}$$

$$[A^1]^+[A^2]^+[M^1]^+[M^2]^+[Y]^{4-} \quad \text{(IIIb);}$$

$$[A^1]^+[M^1]^+[M^2]^+[M^3]^+[Y]^{4-} \quad \text{(IIIc);}$$

$$[A^1]^+[A^2]^+[M^1]^+[Y]^{3-} \quad \text{(IIId);}$$

$$[A^1]^+[M^1]^+[M^2]^+[Y]^{3-} \quad \text{(IIIe);}$$

$$[A^1]^+[M^1]^+[Y]^{2-} \quad \text{(IIIf);}$$

$$[A^1]^+[A^2]^+[M^4]^{2+}[Y]^{4-} \quad \text{(IIIg);}$$

$$[A^1]^+[M^1]^+[M^4]^{2+}[Y]^{4-} \quad \text{(IIIh);}$$

$$[A^1]^+[M^5]^{3+}[Y]^{4-} \quad \text{(IIIi);}$$

$$[A^1]^+[M^4]^{2+}[Y]^{3-} \quad \text{(IIIj)}$$

wherein $[A1]^+$, $[A2]^+$ and $[A3]^+$ are selected independently from one another from the groups named for $[A]^+$, $[Y]^{n-}$ has the significance named under B1) and $[M1]^+$, $[M2]^+[M3]^+$, signify monovalent metal cations, $[M4]^+$ signifies bivalent metal cations and $[M5]^+$ signifies trivalent metal cations;

or mixtures thereof.

Preferable are ionic liquids in which the cation $[A]^+$ is an ammonium cation which in general contains 1 through 5, preferably 1 through 3 and especially preferably 1 to 2 nitrogen atoms.

Suitable cations are for example the cations of the general formulas (IVa) through (IVy)

(IVa)

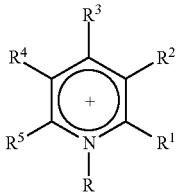

(IVb)

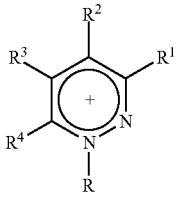

(IVc)

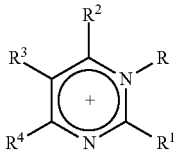

(IVd)

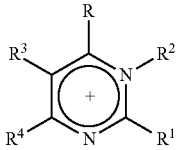

(IVe)

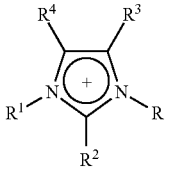

(IVf)

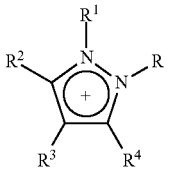

(IVg)

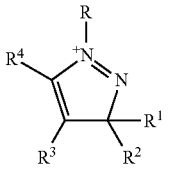

-continued (IVg')

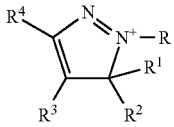

(IVh)

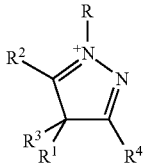

(IVi)

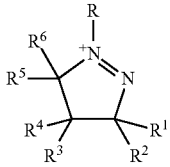

(IVj)

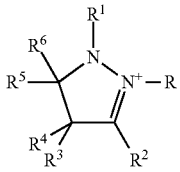

(IVj')

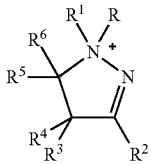

(IVk)

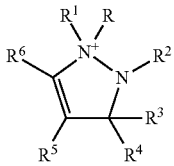

(IVk')

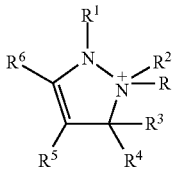

(IVl)

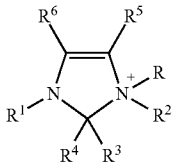

(IVm)

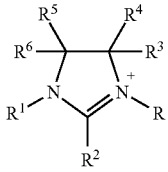

-continued
(IVm′)
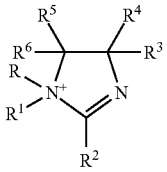
(IVn)
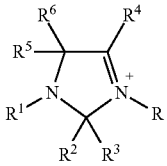
(IVn′)
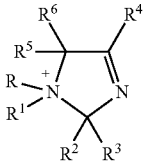
(IVo)
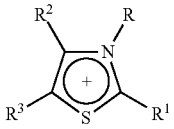
(IVo′)
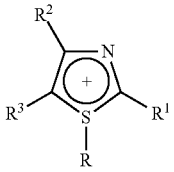
(IVp)
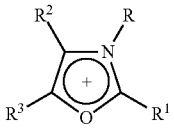
(IVq)
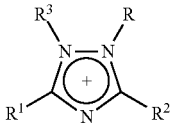
(IVq′)
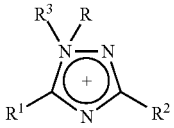
(IVq″)
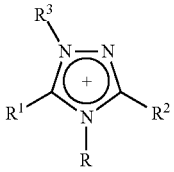
-continued
(IVr)
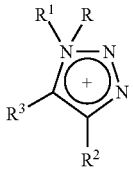
(IVr′)
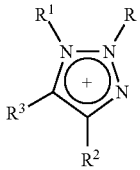
(IVr″)
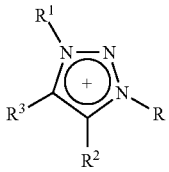
(IVs)
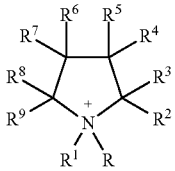
(IVt)
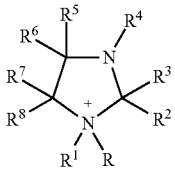
(IVu)
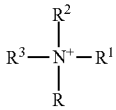
(IVv)
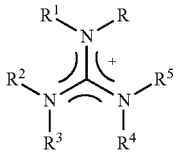
(IVw)
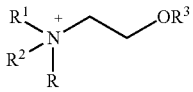
as well as oligomers which contain these structures.
(IVy)
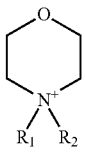
Further morpholinium can be selected.

Another suitable cation is also a phosphonium cation of the general formula (Ivy)

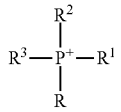

(IVx)

as well as oligomers which contain this structure.

In the above named formulas (IVa) through (IVy)

The residue R can stand for a carbon containing organic, saturated or unsaturated, acyclic or cyclic, aliphatic, aromatic or araliphatic, unsubstituted or interrupted through 1 through 5 heteroatoms or functional groups or substituted residue with 1 to 20 carbon atoms; and residues $R^1$ through $R^9$ independent of each other for hydrogen, a sulfo group or a carbon containing organic, saturated or unsaturated, acyclic or cyclic, aliphatic, aromatic or araliphatic, unsubstituted or interrupted through 1 through 5 heteroatoms or functional groups or substituted residue with 1 to 20 carbon atoms, wherein residues $R^1$ through $R^9$, which in the above named formulas (IV) are bound to a carbon atom (and not to a heteroatom), can additionally stand for halogen or a functional group, or two adjacent residues from the series $R^1$ through $R^9$ together also for a bivalent, carbon containing organic, saturated or unsaturated, acyclic or cyclic, aliphatic, aromatic or araliphatic, unsubstituted or interrupted through 1 through 5 heteroatoms or functional groups or substituted residue with 1 to 30 carbon atoms.

Possible heteroatoms in the case of the definition of the residues R and $R^1$ through $R^9$ are in principle all heteroatoms which are able to formally replace a —CH2-, a —CH═, a —C≡ or a ═C═ group. If the residue containing the carbon contains heteroatoms, oxygen, nitrogen, sulfur, phosphorous and silicon are preferred. As preferred groups in particular —O—, —S—, —SO—, —$SO_2$—, —NR'—, —N═, —PR'—, —POR'— and —$SiR'_2$ are named, wherein the residues R' residues are the remaining part of the residue containing carbon. Residues $R^1$ through $R^9$ can in the process in the cases in which said residues $R^1$ through $R^9$ are bound in the above named formulas (IV) to a carbon atom (and not to a heteroatom), also be bound directly via the heteroatom.

In principle all functional groups which can be bound to a carbon atom or a heteroatom are possible as functional groups. Suitable examples to be named would be —OH (hydroxyl), ═O (in particular as carbonyl group), —$NH_2$ (amino), ═NH (imino), —COOH (carboxy), —$CONH_2$ (carboxamide), —$SO_3H$ (sulfo) and —CN (cyano). Functional groups and heteroatoms can also be directly adjacent, so that also combinations of several adjacent atoms, such as for example —O— (ether), —S-(thioether), —COO— (ester), —CONH— (secondary amide) or —CONR'— (tertiary amide) are included, for example Di-($C_1$-$C_4$alkyl)-amino, $C_1$-$C_4$alkyloxycarbonyl or $C_1$-$C_4$— alkyloxy.

Possible halogens to be named are fluorine, chlorine, bromine and iodine.

Preferably the residue R stands for unbranched or branched, unsubstituted or one to several $C_1$- to $C_{18}$-alkyls substituted with hydroxyl, halogen, phenyl, cyano, C1through C6-alkoxycarbonyl and/or sulfonic acid with in total 1 to 20 carbon atoms, such as for example methyl, ethyl, 1-propyl, 2-propyl, 1-butyl, 2-butyl, 2-methyl-1-propyl(isobutyl), 2-methyl-2-propyl(tert.-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, 2-hydroxyethyl, benzyl, 3-phenylpropyl, 2-cyanoethyl, 2-(methoxycarbonyl)-ethel, 2-(ethoxycarbonyl)-ethyl, 2-(n-butoxycarbonyl)-ethyl, trifluoromethyl, difluoromethyl, fluoromethyl, pentafluoroethyl, heptafluoropropyl, heptafluoroisopropyl, nonafluorobutyl, nonafluoroisobutyl, undecylfluoropentyl, undecylfluoroisopentyl, 6-hydroxyhexyl and propylsulfonic acid; glycols, butylene glycols and their oligomers with 1 to 1000 units and a hydrogen or a $C_1$- to $C_8$-alkyl as terminal group, for example $R^A$O—($CHR^B$—$CH_2$—O)$_p$—$CHR^B$—$CH_2$— or $R^A$O—($CH_2CH_2CH_2CH_2O$)$_p$—$CH_2CH_2CH_2CH_2O$— with $R^A$ and $R^B$ preferably hydrogen, methyl or ethyl and p preferably 0 through 3, in particular 3-oxabutyl, 3-oxapentyl, 3,6-dioxaheptyl, 3,6-dioxaoctyl, 3,6,9-trioxadecyl, 3,6,9-trioxaundecyl, 3,6,9,12-tetraoxamidecyl and 3,6,9,12-tetraoxatetradecyl; vinyl; and N,N-Di-$C_1$-$C_6$-alkylamino, for example N,N-dimethylamino and N,N-diethylamino.

Especially preferably the residue R stands for unbranched and unsubstituted $C_1$-$C_{18}$-alkyl, for example methyl, ethyl, 1-propyl, 1-butyl, 1-pentyl, 1-hexyl, 1-heptyl, 1-octyl, 1-decyl, 1-dodecyl, 1-tetradecyl, 1-hexadecyl, 1-octadecyl, in particular for methyl, ethyl, 1-butyl and 1-octyl as well as for $CH_3O$—($CH_2CH_2O$)$_p$—$CH_2CH_2$— and $CH_3CH_2O$—($CH_2CH_2O$)$_p$—$CH_2CH_2$— with p being equal to 0 through 3.

Preferably residues $R^1$ through $R^9$ stand in the following independently from each other for hydrogen;

halogen;

a functional group;

if applicable signified by substituted functional groups, aryl, alkyl, aryloxy, alkyloxy, halogen, heteroatoms and/or heterocycles and/or through one or more oxygen and/or sulfur atoms and/or one or more substituted or unsubstituted imino groups of interrupted $C_1$-$C_{18}$-alkyl; if applicable signified by functional groups, aryl, alkyl, aryloxy, alkyloxy, halogen, heteroatoms and/or heterocycles of substituted and/or by one or more oxygen and/or sulfur atoms and/or one or more substituted or unsubstituted imino groups of interrupted $C_2$-$C_{18}$-alkyl;

if applicable signified by functional groups, aryl, alkyl, aryloxy, alkyloxy, halogen, heteroatoms and/or heterocycles of substituted $C_6$-$C_{12}$-aryl; if applicable signified by functional groups, aryl, alkyl, aryloxy, alkyloxy, halogen, heteroatoms and/or heterocycles of substituted $C_5$-$C_{12}$-cycloalkyl; if applicable signified by functional groups, aryl, alkyl, aryloxy, alkyloxy, halogen, heteroatoms and/or heterocycles of substituted $C_5$-$C_{12}$-cycloalkenyl;

or a ring if applicable signified by functional groups, aryl, alkyl, aryloxy, alkyloxy, halogen, heteroatoms and/or heterocycles of substituted five-membered to six-membered heterocyclus exhibiting oxygen atoms, nitrogen atoms and/or sulfur atoms; or two adjacent residues together for an unsaturated, saturated or aromatic ring, if applicable substituted by functional groups, aryl, alkyl, aryloxy, alkyloxy, halogen, heteroatoms and/or heterocycles and if applicable interrupted by one or more oxygen atoms and/or sulfur atoms and/or one or more substituted or unsubstituted imino groups.

In the case of the $C_1$-$C_{18}$-alkyl if applicable substituted by functional groups aryl, alkyl, aryloxy, alkyloxy, halogen, heteroatoms and/or heterocycles it is a matter of preferably methyl, ethyl, 1-propyl, 2-propyl, 1-butyl, 2-butyl, 2-methyl-1-propyl(isobutyl), 2-methyl-2-propyl(tert.-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, heptyl, octyl, 2-ethylhexyl, 2,4,4-trimethylpentyl, 1,1,3,3-tetramethylbutyl, 1-nonyl, 1-decyl, 1-undecyl, 1-dodecyl, 1-tridecyl, 1-tetradecyl, 1-pentadecyl, 1-hexadecyl, 1-heptadecyl, 1-octadecyl, cyclopentylmethyl, 2-cyclopentylethyl, 3-cyclopentylpropyl, cyclohexylmethyl, 2-cyclohexylethyl, 3-cyclohexylethyl, 3-cyclohexylpropyl, benzyl(phenylmethyl), diphenylmethyl(benzylhydryl), triphenylmethyl, 1-phenylethyl, 2-phenylethyl, 3-phenylpropyl, α,α-dimethylbenzyl, p-tolylmethyl, 1-(p-butylphenyl)-ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-Di-(methoxycarbonyl)-ethyl, methoxy, ethoxy, formyl, 1,3-Dioxolan-2yl, 1,3-dioxane-2-yl, 2-methyl-1,3-dioxolan-2-yl, 4-methyl-1,3-dioxolan-2-yl, 2-hydroxyethyl, 2-hydroxypropyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxyethyl, 2-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl, 6-ethoxyhexyl, acetyl, $C_qF_{2(q-a)+(1-b)}H2a+b$ with q equaling 1 to 30, $0 \leq a \leq q$ and b=0 or 1 (for example $CF_3$, $C_2F_5$, $CH_2CH_2$—$C_{(q-2)}F_{2(q-2)+1}$, $C_6F_{13}$, $C_8F_{17}$, $C_{10}F_{21}$, $C_{12}F_{25}$), chloromethyl, 2-chloromethyl, trichloromethyl, 1,1-dimethyl-2-chloroethyl, methoxymethyl, 2-butoxypropyl, 2-octyloxyethyl, 2-methoxyisopropyl, 2-(methoxycarbonyl)-ethyl, 2-(ethoxycarbonyl)-ethyl, 2-(n-butoxycarbonyl)-ethyl, butylthiomethyl, 2-dodecylthioethyl, 2-phenylthioethyl, 5-hydroxy-3-oxa-pentyl, 8-hydroxy-3,6-dioxa-octyl, 11-hydroxy-3,6,9-trioxa-undecyl, 7-hydroxy-4-oxa-heptyl, 11-hydroxy-4,8-dioxa-undecyl, 15-hydroxy-4,8,12-trioxa-pentadecyl, 9-hydroxy-5-oxa-nonyl, 14-hydroxy-5,10-dioxa-tetradecyl, 5-methoxy-3-oxa-pentyl, 8-methoxy-3,6-dioxa-octyl, 11-methoxy-3,6,9-trioxa-undecyl, 7-methoxy-4-oxa-heptyl, 11-methoxy-4,8-dioxa-undecyl, 15-methoxy-4,8,12-trioxa-pentadecyl, 9-methoxy-5-oxa-nonyl, 14-methoxy-5-10-dioxa-tetradecyl, 5-ethoxy-3-oxy-pentyl, 8-ethoxy-3,6-dioxa-octyl, 11-ethoxy-3,6,9-trioxa-undecyl, 7-ethoxy-4-oxa-heptyl, 11-ethoxy-4,8-dioxa-undecyl, 15-ethoxy-4,8,12-trioxa-pentadecyl, 9-ethoxy-5-oxa-nonyl or 14-ethoxy-5-10-oxa-tetradecyl.

In the case of $C_2$-$C_{18}$-alkenyl if applicable substituted by functional groups aryl, alkyl, aryloxy, alkyloxy, halogen, heteroatoms and/or heterocycles and/or interrupted by one or more substituted or unsubstituted imino groups it is preferably a matter of vinyl, 2-propenyl, 3-butenyl, c-s-2-butenyl, trans-2-butenyl or $C_qF_{2(q-a)-(1-b)}H_{2a-b}$ with $q \leq 30$, $0 \leq a \leq q$ and b=0 or 1.

In the case of $C_6$-$C_{12}$-aryl if applicable substituted by functional groups aryl, alkyl, aryloxy, alkyloxy, halogen, heteroatoms and/or heterocycles it is preferably a matter of phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, iso-propylphenyl, tert.-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dinitrophenyl, 4-dimethylaminohenyl, 4-acetylphenyl, methoxyethylphenyl, ethoxymethylphenyl, methylthiophenyl, isopropylthiophenyl or tert.-butylthiophenyl or $C_6F_{(5-a)}H_a$ with $0 \leq a \leq 5$.

In the case of $C_5$- through $C_{12}$-cycloalkyl if applicable substituted by functional groups aryl, alkyl, aryloxy, alkyloxy, halogen, heteroatoms and/or heterocycles it is preferably a matter of cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl, $C_qF_{2(q-a)-(1-b)}H_{2a-b}$ with $q \leq 30$, $0 \leq a \leq q$ and b=0 or 1 as well as a saturated or unsaturated bicyclic system such as e.g. norbornyl or norbornenyl.

In the case of $C_5$-through $C_{12}$-cycloalkenyl if applicable substituted by functional groups aryl, alkyl, aryloxy, alkyloxy, halogen, heteroatoms and/or heterocycles it is preferably a matter of 3-cyclopentenyl, 2-cyclohexenyl, 3-cyclohexenyl, 2,5-cyclohexadienyl or $C_qF_{2(q-a)-3(1-b)}H_{2a-3b}$ with $q \leq 30$, $0 \leq a \leq q$ and b=0 or 1.

In the case of a heterocyclus exhibiting five-membered to six-membered oxygen atoms, nitrogen atoms and/or sulfur atoms if applicable substituted by functional groups aryl, alkyl, aryloxy, alkyloxy, halogen, heteroatoms and/or heterocycles it is preferably a matter of furyl, thiophenyl, pyrryl, pyridyl, indolyl, benzoxazolyl, dioxolyl, benzimidazolyl, benzthiazolyl, dimethylpridyl, methylchinolyl, dimethylpyrryl, methoxyfuryl, dimethoxypyridyl or difluoropyridyl.

If two adjacent residues together form an unsaturated, saturated or aromatic ring if applicable substituted by functional groups aryl, alkyl, aryloxy, alkyloxy, halogen, heteroatoms and/or heterocycles and/or if applicable interrupted by one or more substituted or unsubstituted imino groups, it is preferably a matter of 1,3-propylene, 1,4-butylene, 1,5-pentylene, 2-oxa-1,3-propylene, 1-oxa-1,3-propylene, 2-oxa-1,3-propylene, 1-oxa-1,3-propylene, 3-oxa-1,5-pentylene, 1-aza-1,3-propenylene, 1-C1-C4-alkyl-1-aza-1,3-propenylene, 1,4-buta-1,3-dienylene, 1-aza-1,4-buta-1,3-dienylene or 2-aza-1,4-buta-1,3-dienylene.

If the above named residues contain oxygen atoms and/or sulfur atoms and/or substituted or unsubstituted imino groups, the number of oxygen atoms and/or sulfur atoms and/or imino groups is not restricted. As a rule it amounts to no more than 5 in the residue, preferably not more than 4 and very especially preferably not more than 3.

If the above named residues contain heteroatoms, as a rule between two heteroatoms there is at least one carbon atom, preferably at least two carbon atoms.

Especially preferably residues $R^1$ through $R^9$ stand independently from each other for hydrogen;

unbranched or branched, unsubstituted or one to several $C_1$- to $C_{18}$-alkyls substituted with hydroxyl, halogen, phenyl, cyano, C1- through C6-alkoxycarbonyl and/or sulfonic acid with in total 1 to 20 carbon atoms, such as for example methyl, ethyl, 1-propyl, 2-propyl, 1-butyl, 2-butyl, 2-methyl-1-propyl(isobutyl), 2-methyl-2-propyl(tert.-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, 2-hydroxyethyl, benzyl, 3-phenylpropyl, 2-cyanoethyl, 2-(methoxycarbonyl)-ethel, 2-(ethoxycarbonyl)-ethyl, 2-(n-butoxycarbonyl)-ethyl, trifluoromethyl, difluoromethyl, fluoromethyl, pentafluoroethyl, heptafluoropropyl, heptafluoroisopropyl, nonafluorobutyl, nonafluoroisobutyl, undecylfluoropentyl, undecylfluoroisopentyl, 6-hydroxyhexyl and propylsulfonic acid; glycols, butylene glycols and their oligomers with 1 to 1000 units and a hydrogen or a $C_1$- to $C_8$-alkyl as terminal group, for example $R^AO—(CHR^B—CH_2—O)_p—CHR^B—CH_2—$ or $R^AO—(CH_2CH_2CH_2CH_2O)_p—CH_2CH_2CH_2CH_2O—$ with $R^A$ and $R^B$ preferably hydrogen, methyl or ethyl and p preferably 0 through 3, in particular 3-oxabutyl, 3-oxapentyl, 3,6-dioxaheptyl, 3,6-dioxaoctyl, 3,6,9-trioxadecyl, 3,6,9-trioxaundecyl, 3,6,9,12-tetraoxamidecyl and 3,6,9,12-tetraoxatetradecyl;

vinyl; and

N,N-Di-$C_1$-$C_6$-alkylamino, for example N,N-dimethylamino and N,N-diethylamino.

Very especially preferably residues $R^1$ through $R^9$ stand independently from each other for hydrogen or $C_1$- to $C_{18}$-alkyl, for example methyl, ethyl, 1-propyl, 1-butyl, 1-pentyl, 1-hexyl, 1-heptyl, 1-octyl, for phenyl, 2-hydroxyethyl, 2-cyanoethyl, 2-(methoxycarbonyl)ethel, 2-(ethoxycarbonyl) ethyl, 2-(n-butoxycarbonyl)ethyl, for N,N-dimethylamino and N,N-diethylamino, for chlorine, as well as $CH_3O—(CH_2CH_2O)_p—CH_2CH_2—$ and $CH_3CH_2O—(CH_2CH_2O)_p—CH_2CH_2—$ with p being equal to 0 through 3.

Very especially preferable are ionic fluids in which case the cation $[A]^+$ is a pyridinium ion (IVa), in which case one of residues $R^1$ through $R^5$ is methyl, ethyl or chlorine and the remaining residues $R^1$ through $R^5$ are hydrogen;

$R^3$ is dimethylamino and the remaining residues $R^1$ $R^2$, $R^4$ and $R^5$ are hydrogen; all residues $R^1$ through $R^5$ are hydrogen;

$R^2$ is carboxy or carboxamide and the remaining residues $R^1$ $R^2$, $R^4$ and $R^5$ are hydrogen; or $R^1$ and $R^2$ or $R^2$ and $R^3$ are 1,4-buta-1,3dienylene and the remaining residues $R^1$ $R^2$, $R^4$ and $R^5$ are hydrogen;

and in particular such in which case $R^1$ through $R^5$ are hydrogen; or one of residues $R^1$ through $R^5$ is methyl or ethyl and the remaining residues $R^1$ through $R^5$ are hydrogen.

To be named as very especially preferred pyridinium ions (IVa) are 1-methyl pyridinium, 1-ethyl pyridinium, 1-(1-butyl)pyridinium, 1-(1-hexyl)pyridinium, 1-(1-octyl)pyridinium, 1-(1-hexyl)-pyridinium, 1-(1-octyl)-pyridinium, 1-(1-dodecyl)-pyridinium, 1-(1-tetradecyl)-pyridinium, 1-(1-hexadecyl)-pyridinium, 1,2-dimethylpyridinium, 1-ethyl-2-methylpyridinium, 1-(1-butyl)-2-methylpyridinium, 1-(1-hexyl)-2-methylpyridinium, 1-(1-octyl)-2-methylpyridinium, 1-(1-dodecyl)-2-methylpyridinium, 1-(1-tetradecyl)-2-methylpyridinium, 1-(1-hexadecyl)-2-methylpyridinium, 1-methyl-2-ethyl pyridinium, 1,2-diethyl pyridinium, 1-(1-butyl)-2-ethyl pyridinium, 1-(1-hexyl)-2-ethyl pyridinium, 1-(1-octyl)-2-ethyl pyridinium, 1-(1-dodecyl)-2-ethyl pyridinium, 1-(1-tetradecyl)-2-ethyl pyridinium, 1-(1-hexadecyl)-2-ethyl pyridinium, 1,2-dimethyl-5-ethyl pyridinium, 1,5-diethyl-2-methylpyridinium, 1-(1-butyl)-2-methyl-3-ethyl pyridinium, 1-(1-hexyl)-2-methyl-3-ethyl pyridinium and 1-(1-octyl)-2-methyl-3-ethyl pyridinium, 1-(1-dodecyl)-2-methyl-3-ethyl pyridinium, 1-(1-tetradecyl)-2-methyl-3-ethyl pyridinium, and 1-(1-hexadecyl)-2-methyl-3-ethyl pyridinium.

Very especially preferable are ionic fluids in which case the cation $[A]^+$ is a pyridazinium ion (IVb) in which case $R^1$ through $R^4$ are hydrogen; or one of residues $R^1$ through $R^4$ is methyl or ethyl and the remaining residues $R^1$ through $R^4$ are hydrogen Very especially preferable are ionic fluids in which case the cation $[A]^+$ is a pyrimidinium ion (IVc) in which case $R^1$ is hydrogen, methyl or ethyl and $R^2$ through $R^4$ are independently from each other hydrogen or methyl; or $R^1$ is hydrogen, methyl or ethyl, $R^2$ and $R^4$ are methyl and $R^3$ is hydrogen.

Very especially preferable are ionic fluids in which case the cation $[A]^+$ is a pyrazinium ion (IVd) in which case $R^1$ is hydrogen, methyl or ethyl and $R^2$ through $R^4$ are independently from each other hydrogen or methyl;

$R^1$ is hydrogen, methyl or ethyl, $R^2$ and $R^4$ are methyl and $R^3$ is hydrogen, $R^1$ through $R^4$ are methyl; or $R^1$ through $R^4$ are methyl hydrogen.

Very especially preferable are ionic fluids in which case the cation $[A]^+$ is an imidazolium ion (IVe) in which case $R^1$ is hydrogen, methyl or ethyl, 1-propyl, 1-butyl, 1-pentyl, 1-hexyl, 1-octyl, 2-hydroxyethyl or 2-cyanoethyl and $R^2$ through $R^4$ are independently from each other hydrogen, methyl or ethyl.

To be named as very especially preferable imidazolium ions (IVe) are 1-methyl imidazolium. 2-ethyl imidazolium, 1-(1-butyl)-imidazolium, 1-(1-octyl)-imidazolium, 1-(1-dodecyl)-imidazolium, 1-(1-tetradecyl)-imidazolium, 1-(1-hexadecyl)-imidazolium, 1,3-dimethyl imidazolium, 1-ethyl-3-methyl imidazolium, 1-(1-butyl)-3-methyl imidazolium, 1-(1-butyl)-3-ethyl imidazolium, 1-(1-hexyl)-3-butyl-imidazolium, 1-(1-octyl)-3-methyl imidazolium, 1-(1-octyl)-3-ethyl imidazolium, 1-(1-octyl)-3-butyl imidazolium, 1-(1-dodecyl)-3-methyl imidazolium, 1-(dodecyl)-3-ethyl imidazolium, 1-(1-dodecyl)-3-butyl imidazolium, 1-(dodecyl)-3-octyl imidazolium, 1-(1-tetradecyl)-3-methyl imidazolium, 1-(1-tetradecyl)-3-ethyl imidazolium, 1-(1-tetradecyl)-3-butyl imidazolium, 1-(1-tetradecyl)-3-octyl imidazolium, 1-(1-hexadecyl)-3-methyl imidazolium, 1-(1-hexadecyl)-3-ethyl imidazolium, 1-(1-hexadecyl)-3-butyl imidazolium, 1-(1-hexadecyl)-3-octyl imidazolium, 1,2-dimethyl imidazolium, 1,2,3-trimethyl imidazolium, 1-ethyl-2,3-dimethyl imidazolium, 1-(1-butyl)-2,3-dimethyl imidazolium, 1-(1-hexyl)-2,3-dimethyl-imidazolium, 1-(1-octyl)-2,3-dimethyl imidazolium, 1,4-dimethyl imidazolium, 1,3,4-trimethyl imidazolium, 1,4-dimethyl-3-ethyl imidazolium, 3-butyl imidazolium, 1,4-dimethyl-3-octyl imidazolium, 1,4,5 trimethyl imidazolium, 1,3,4,5-tetramethyl imidazolium, 1,4,5-trimethyl-3-ethyl imidazolium, 1,4,5-trimethyl-3-butyl imidazolium and 1,4,5-trimethyl-3-octyl-imidazolium.

In the following exemplary embodiments of the invention are more closely described by means of figure representations. Said figures show the following:

Figure 1:
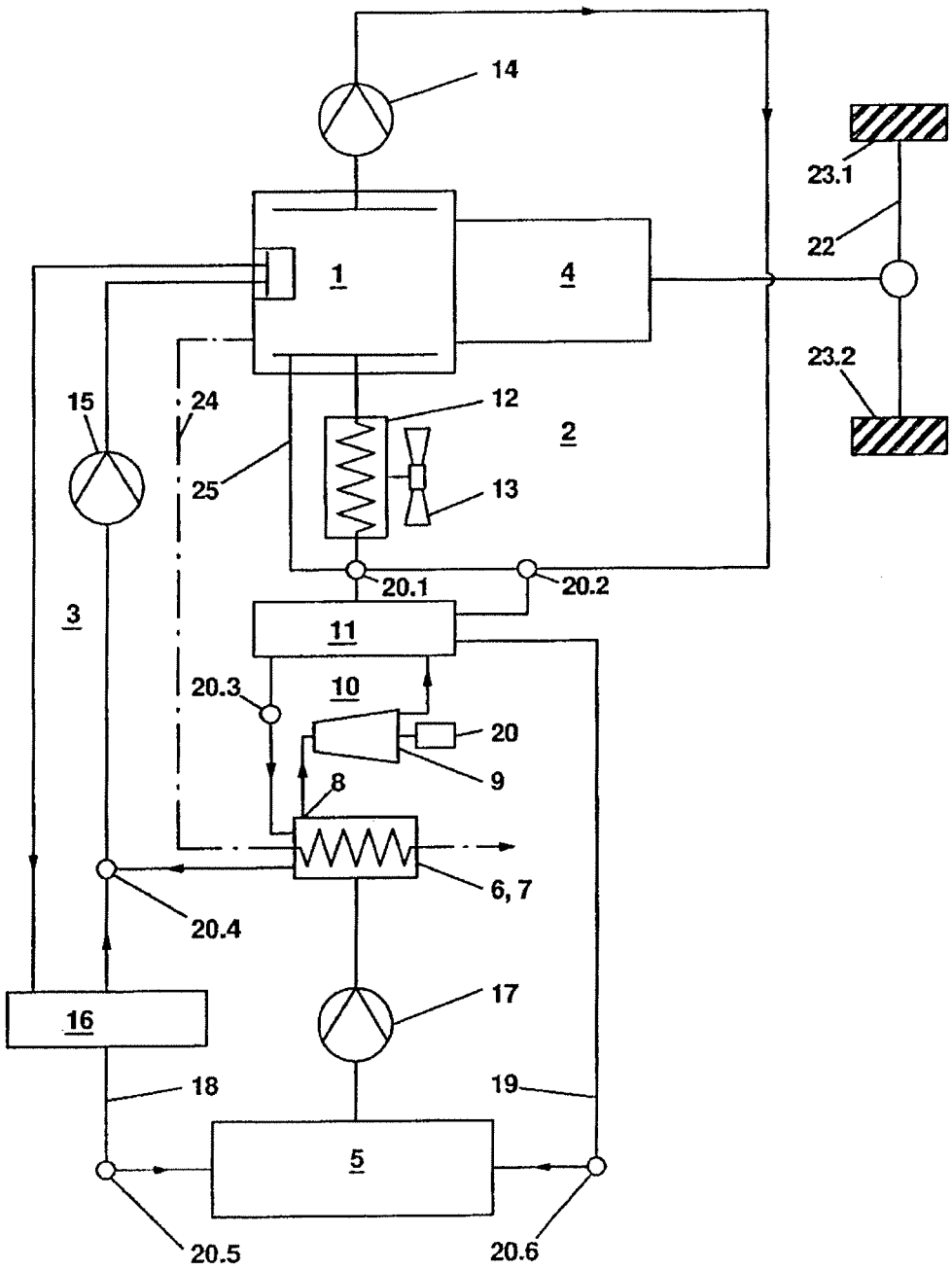
FIG. 1 shows a drive unit in accordance with the invention in a configuration with an additional vapor circuit processing device, for which one uniform operating fluid is provided.

FIG. 1 shows an inventive drive unit in schematically simplified manner. For the present exemplary embodiment the drive unit comprises a drive machine 1 in the form of an internal combustion engine which functions via a transmission 4 on a shaft 22 with the drive gears 23.1, 23.2. The drive unit comprises a cooling system 2 with a coolant pump 14 and a air/coolant heat exchanger 12, to which a fan 13 is assigned. For the present embodiment the drive machine 1 is cooled. In addition the drive unit comprises a lubricating circuit 3 which feeds the drive machine 1 lubricant via a lubricant pump 15.

In accordance with the invention the cooling system 2 and the lubricating circuit are fluidically connected, by means of producing the coolant and the lubricant as withdrawal from a comprehensive operating medium. In the process the comprehensive operating medium is stockpiled in an accumulation reservoir 5 and comprises an ionic fluid and a vaporizable fluid, in particular water. The comprehensive operating medium is conveyed via the primary pump 17 and for separation or partial separation of the ionic fluid from the vaporizable fluid reaches a separator device 6, presently an evaporator 7. Said evaporator is supplied via the exhaust gas duct 24 from the drive machine 1 with a heat flow. As a result a evaporation of part of the vaporizable fluid occurs, said vaporizable fluid leaving the 7 at the outlet for the vapor phase 8. This vapor phase passes through an expander 9 of a vapor circuit processing device 10, which drives an electric generator 20, wherein the vapor phase performs mechanical work when released. Subsequent to the expander 9 a condenser not shown in detail can be arranged or in accordance with the present exemplary embodiment a direct supply to a reservoir 11 for the coolant can take place. Then coolant is brought back to the evaporator 7 via the valve 20.3 for operation of the vapor circuit processing device 10 for use as a working fluid.

From the reservoir for the coolant 11 supplying takes place via the valve 20.1 to the cooling circuit of the cooling system 2. The return flow of the heated coolant can after appropriate switching of the valve 20.2 be brought back to the reservoir for the coolant 11, wherein advantageously the coolant located within, which at the same time is the working fluid of the vapor circuit processing device 10 can be pre-heated prior to entry into the evaporator 7. If the temperature in the reservoir increases for the coolant 11 beyond a pre-defined temperature value, in the case of the appropriate switching of valves 20.1, 20.2 the reservoir for the coolant 22 can be circumvented in the circulation of the coolant. In addition there is a bypass 25 for circumvention of the air/coolant heat exchanger 12 in the case of a cold drive machine 1.

A further withdrawal from the evaporator 7 of a lubricant enriched with the ionic fluid leads to the lubricating circuit 3. In the process the lubricant can in the case of appropriate switching of the valve 20.4 be stockpiled in the reservoir for the lubricant 16. In the case of sufficient filling of the reservoir for the lubricant 16 the supply from the evaporator 7 on the valve 20.4 can be completely cut off. For the present embodiment due to the high temperature resistance of the ionic fluid no separate heat exchanger is provided for cooling in the lubricating circuit 3. However, such a heat exchanger is conceivable if the lubricant enriched with the ionic fluid is used at the same time for cooling of a high temperature component of the drive machine.

Via the return pipes 18 and 19 a return flow can take place from the reservoir for the coolant 11 and from the reservoir for the lubricant 16 to the accumulation reservoir 5 in the case of an appropriate switching of valves 20.5 and 20.6. This will be the case in particular in the case of shutdown of the drive unit, provided the frost protection must be ensured through a low melting point of the mixture of ionic fluid and vaporizable fluid in the comprehensive operating fluid.

Figure 2:
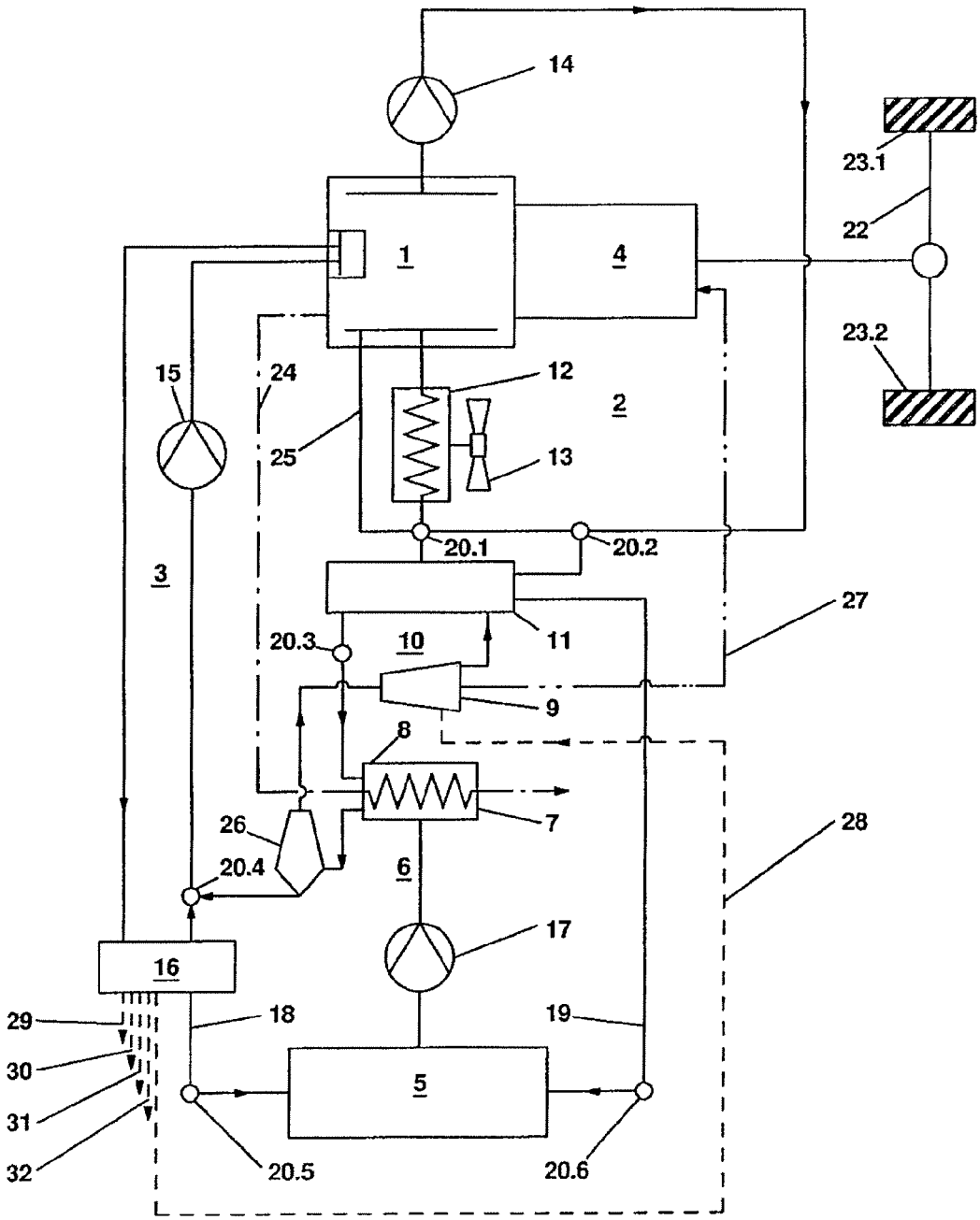
FIG. 2 shows a further design of the drive unit from FIG. 1.

A further exemplary embodiment of the invention is outlined in FIG. 2. In the process for components that match the embodiment in accordance with FIG. 1 the same reference symbols are used. Shown in outline form is the coupling of further fluidic circuits to the reservoir for the lubricant 16, in particular it is a matter of a connection to an air compressor lubrication 29, a connection to steering system hydraulics 30, a connection to retarder hydraulics 31 and a connection to a hydrostatic drive 32. Further a connection to the expander lubrication 28 which reaches the expander 9 is provided. At least a part of the named fluidic connections can proceed from the accumulation reservoir 5 for an alternative embodiment not shown in the figure.

Further FIG. 2 shows an embodiment with a separator 26 downstream from the evaporator 7, in which a separation of the vapor and fluid phases is performed. In the process the vapor phase is fed to the expander 9 and the fluid phase is fed to the reservoir for the lubricant 16. In addition for the exemplary embodiment shown the mechanical performance generated by the expander 9 is transferred by means of a preferably switchable expander coupling 27 to the drive train. Presently the coupling takes place on the secondary side of the transmission 4.

Additional embodiments of the invention are conceivable within the scope of the subsequent protective claims. In particular the possibility exists of adding additional additive to the comprehensive operating fluid or carrying out such an admixture in a section of the fluidic system connected to the accumulation reservoir 5. In the process it is in particular preferred to add an ionic fluid locally for adaptation to a specified function, said ionic fluid being separable in turn prior to restoration to the accumulation reservoir 5. In the process a preparation of the fluid withdrawal for use in a braking system is possible.

LIST OF REFERENCE SYMBOLS

1 Drive machine
2 Cooling system
3 Lubricating circuit
4 Transmission
5 Accumulation reservoir
6 Separator device
7 Evaporator
8 Outlet for the vapor phase
9 Expander
10 Vapor circuit processing device
11 Reservoir for the coolant
12 Air/coolant heat exchanger
13 Fan
14 Coolant pump
15 Lubricant pump
16 Reservoir for the lubricant
17 Primary pump
18, 19 Return pipe
20 Electric generator
20.1, 20.2
20.3, 20.4
20.5, 20.6 Valve

22 Shaft
23.1, 23.2 Drive gear
24 Exhaust gas duct
25 Bypass
26 Separator
27 Expander coupling
28 Connection to the expander lubrication system
29 Connection to the air compressor lubrication system
30 Connection to the steering system hydraulics
31 Connection to the retarder hydraulics
32 Connection to a hydrostatic drive

What is claimed is:

1. A drive unit, comprising a drive machine for generating driving power;

a cooling system for the fluid cooling of the drive machine, wherein in the cooling system a coolant circulates;

a lubricating circuit for the lubrication of at least one movable component of the drive unit with a lubricant, wherein the drive unit further comprises an accumulation reservoir, in which a comprehensive operating fluid, which comprises a mixture of at least one ionic fluid and at least one vaporizable fluid, is stockpiled, wherein the cooling system and the lubricating circuit are at least indirectly fluidically connected to the accumulation reservoir in order to extract a lubricant and a coolant from the comprehensive operating fluid.

2. The drive unit according to claim 1, wherein the vaporizable fluid is water.

3. The drive unit according to claim 1, wherein the comprehensive operating fluid comprises a minimum proportion by weight of the ionic fluid and the vaporizable fluid, each amounting to 0.01 percentage by weight.

4. A drive unit according to claim 1, wherein a melting temperature of the comprehensive operating fluid at least in the accumulation reservoir lies below 0° C.

5. The drive unit according to claim 1, wherein the drive unit further comprises a separator device fluidly connected to the accumulation reservoir and operable to at least partially separate the ionic fluid and the vaporizable fluid in the comprehensive operating fluid.

6. The drive unit according to claim 5, wherein the separator device comprises an evaporator, wherein the evaporator are at least indirectly fluidically connected to an expander of a vapor circuit processing device.

7. The drive unit according to claim 6, wherein the expander is connected downstream to a reservoir for the coolant.

8. The drive unit according to claim 1, further comprising means for setting a concentration ratio of the ionic fluid to the vaporizable fluid in one of the lubricant, the coolant, and the lubricant and coolant.

9. The drive unit according claim 1, wherein the accumulation reservoir comprises at least one of a connection to an expander lubrication system, a connection to an air compressor lubrication system, a connection to a system of steering hydraulics, a connection to a retarder, a connection to a hydrostatic drive and a connection to a braking system.

10. The drive unit according to claim 1, wherein the accumulation reservoir is fluidically connected to at least one of a retarder, a steering system and a braking system for the operation of hydraulic medium extracted from the comprehensive operating fluid.

11. The drive unit according to claim 1, wherein a decomposition temperature of the ionic fluid is higher than 200° C.

12. The drive unit according to claim 1, wherein an anion of the ionic fluid comprises a C1 through C4 alkyl sulfonate.

13. The drive unit according to claim 1, wherein a cation of the ionic fluid comprises at least one cation selected from the group consisting of a pyridinium, imidazolium, phosphonium, and morpholinium and combinations of the foregoing; and the anion of the ionic fluid comprises at least one anion selected from the group consisting of a C1 through C4 alkyl sulfonate, and an at least partially fluorinated C1 through C4 alkyl sulfonate and combinations of the foregoing.

14. The drive unit according to claim 1, wherein the ionic fluid comprises a cation comprising a methyl-imidazolium (EMIM) and at least one anion selected from the group consisting of $HSO_4^-$, $MeSO_3^-$, $CF_3SO_3^-$, and combinations of the foregoing.

15. The drive unit according to claim 1, wherein a mixture of at least two ionic fluids is present in the comprehensive operating fluid.

16. A method for the operation of a drive unit with a drive machine for generating driving power;

a cooling system for the fluid cooling of the drive machine, wherein in the cooling system a coolant circulates;

a lubricating circuit for the lubrication of at least one movable component of the drive unit with a lubricant, the method comprising:

supplying a comprehensive operating fluid comprising a mixture of an ionic fluid and a vaporizable fluid from an accumulation reservoir to a separator device;

at least partially separating the mixture of the ionic fluid and the vaporizable fluid of the comprehensive operating fluid in the separator device and supplying a coolant from the comprehensive operating fluid with an increased proportion by weight of the ionic fluid compared to the comprehensive operating fluid by the separator device to the cooling system and supplying a withdrawal of the comprehensive operating fluid as a lubricant to the lubricating circuit.

17. The drive unit according to claim 2, wherein the comprehensive operating fluid comprises a minimum proportion by weight of the ionic fluid and the vaporizable fluid, each amounting to 0.01 percentage by weight.

18. A drive unit according to claim 2, wherein a melting temperature of the comprehensive operating fluid at least in the accumulation reservoir lies below 0° C.

19. A drive unit according to claim 3, wherein a melting temperature of the comprehensive operating fluid at least in the accumulation reservoir lies below 0° C.

20. The drive unit according to claim 5, further comprising means for setting a concentration ratio of the ionic fluid to the vaporizable fluid in one of the lubricant, the coolant, and the lubricant and coolant.

21. A drive unit, comprising:

a drive machine for generating driving power;

a cooling system for the fluid cooling of a component of the drive unit which is supplied at least indirectly with driving power by the drive machine, wherein in the cooling system a coolant circulates;

a lubricating circuit for the lubrication of at least one movable component of the drive unit with a lubricant, wherein the drive unit further comprises an accumulation reservoir, in which a comprehensive operating fluid, which comprises a mixture of at least one ionic fluid and at least one vaporizable fluid, is stockpiled, wherein the cooling system and the lubricating circuit are at least indirectly fluidically connected to the accumulation reservoir in order to extract a lubricant and a coolant from the comprehensive operating fluid.

* * * * *